US008381376B2

(12) United States Patent
Halstead et al.

(10) Patent No.: US 8,381,376 B2
(45) Date of Patent: Feb. 26, 2013

(54) METHOD OF MANUFACTURING A FIBROUS STRUCTURE AND AN APPARATUS THEREFOR

(75) Inventors: Tom Lloyd Halstead, West Yorksire (GB); Betty Halstead, legal representative, West Yorkshire (GB); Richard Allen, Halifax (GB)

(73) Assignee: Richard Allen, Pellon Halifax (GB)

( * ) Notice: Subject to any disclaimer, the term of this patent is extended or adjusted under 35 U.S.C. 154(b) by 233 days.

(21) Appl. No.: 12/743,119

(22) PCT Filed: Nov. 14, 2008

(86) PCT No.: PCT/GB2008/003836

§ 371 (c)(1), (2), (4) Date: Oct. 18, 2010

(87) PCT Pub. No.: WO2009/063210

PCT Pub. Date: May 22, 2009

(65) Prior Publication Data

US 2011/0081816 A1 Apr. 7, 2011

(30) Foreign Application Priority Data

Nov. 16, 2007 (GB) ..... 0722464.5

(51) Int. Cl.

| | |
|---|---|
| ***D04H 5/02*** | (2006.01) |
| ***D04H 5/08*** | (2006.01) |
| ***D04H 3/02*** | (2006.01) |
| ***D04H 3/10*** | (2012.01) |

(52) U.S. Cl. ..... 28/103; 28/104; 28/107

(58) Field of Classification Search ..... 28/107, 28/109, 110, 112, 115, 103, 104, 105, 114; 156/148; 19/299, 296, 300, 302, 160, 161.1, 19/163

See application file for complete search history.

(56) References Cited

U.S. PATENT DOCUMENTS

| | | | | | |
|---|---|---|---|---|---|
| 14,120 | A | * | 1/1856 | Sutherland | 28/190 |
| 1,529,701 | A | * | 3/1925 | Hewitt | 15/230.13 |
| 3,422,510 | A | * | 1/1969 | Frate et al. | 28/104 |
| 3,551,265 | A | * | 12/1970 | Jackson | 428/107 |
| 3,756,893 | A | * | 9/1973 | Smith | 156/440 |
| 3,909,893 | A | * | 10/1975 | Wilde | 28/110 |
| 3,952,121 | A | * | 4/1976 | Dilo | 428/34.1 |

(Continued)

FOREIGN PATENT DOCUMENTS

| | | |
|---|---|---|
| EP | 0147297 A | 7/1985 |
| EP | 0232059 A | 8/1987 |

(Continued)

*Primary Examiner* — Amy Vanatta

(74) *Attorney, Agent, or Firm* — Egbert Law Offices, PLLC

(57) ABSTRACT

A method of manufacturing a fibrous structure is particularly, though not exclusively, applicable to the manufacture of friction products such as preform discs. The method comprises mounting a former on a shaft. First feeds of fibrous material are spaced along the shaft and applied to the former in a direction tangential to the shaft as the shaft is rotated. A second feed is also applied to the former in a direction substantially parallel to the longitudinal axis of the shaft. The fibrous materials in the feeds overlie as the shaft rotates and the thickness of the material applied to the former increases to form the fibrous structure. Lengths of the first and/or second feeds are then inserted into the fibrous structure body in a radial direction with respect to the shaft as the shaft is rotated to interconnect the overlying layers and hold the structure together.

9 Claims, 6 Drawing Sheets

U.S. PATENT DOCUMENTS

| | | | | | |
|---|---|---|---|---|---|
| 4,621,662 | A | * | 11/1986 | Olry | 138/129 |
| 4,790,052 | A | * | 12/1988 | Olry | 28/110 |
| 5,081,754 | A | * | 1/1992 | Lawton et al. | 29/419.1 |
| 5,174,228 | A | * | 12/1992 | Grimnes | 112/475.01 |
| 5,348,598 | A | * | 9/1994 | Vives et al. | 156/93 |
| 5,396,689 | A | * | 3/1995 | Vuillaume | 28/103 |
| 5,413,849 | A | * | 5/1995 | Austin et al. | 442/329 |
| 5,813,101 | A | * | 9/1998 | Fehrer | 28/114 |
| 5,858,890 | A | * | 1/1999 | Sheehan et al. | 442/392 |
| 6,105,223 | A | * | 8/2000 | Brown et al. | 28/111 |
| 2006/0090314 | A1 | * | 5/2006 | Delecroix | 28/100 |
| 2010/0037441 | A1 | * | 2/2010 | Lescostaouec | 28/107 |

FOREIGN PATENT DOCUMENTS

| | | | | |
|---|---|---|---|---|
| EP | 0517593 | A | | 12/1992 |
| EP | 0748781 | A | | 12/1996 |
| GB | 2048424 | | * | 12/1980 |
| GB | 2099365 | A | | 12/1982 |
| GB | 2177431 | A | | 1/1987 |
| GB | 2428253 | A | | 1/2007 |
| WO | 9849382 | A | | 11/1998 |
| WO | 03100148 | A | | 12/2003 |

* cited by examiner

METHOD OF MANUFACTURING A FIBROUS STRUCTURE AND AN APPARATUS THEREFOR

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a method of manufacturing a fibrous structure and to an apparatus therefor. The invention is particularly, though not exclusively, applicable to the manufacture of friction products such as preform discs for use in brake mechanisms, and to hollow structures such as preform cones, nozzles and the like for projectiles and aircraft.

2. Description of Related Art Including Information Disclosed Under 37 CFR 1.97 and 37 CFR 1.98

Use of the term 'preform' indicates that the structures manufactured in accordance with the present invention are heated in an autoclave at an appropriate temperature for an appropriate period of time in order to produce a hardened carbonaceous structure. Such a structure is made of carbon that is reinforced with carbon fibres. Suitable carbon fibres for use in the manufacture of such a structure are well known to those in the art and are, for example, sold under the registered trade mark SIGRAFIL®. Alternatively, suitable carbonizable fibres for use in the production of the preform are also known to persons skilled in the art and may comprise oxidized polyacrylonitrile fibers or precursors of polyacrylonitrile fibers of various types such as are sold under the registered trade mark PANOX®. These fibres are converted to carbon fibres by the heat treatment and produce carbon particles which enter and fill voids in the preform to densify the structure. Both types of fibres may be produced in a continuous tow, sliver, roving or yarn form, each of which is made up of a large number of flexible filaments, for example between 30,000 and 350,000 filaments, in order that the preform can be manufactured using textile techniques. Other fibres that are impregnated with resin are also suitable for use in the production of preforms. These are then also carbonizable.

Conventional preform discs for use in brake mechanisms are manufactured in various ways. EP 0 748 781 (B.F. Goodrich) describes a method of making a preform wherein braided tapes are spirally wound and connected together by needle punching. The braid has helical fibre along its length so that none of the fibres making up the disc ever extends linearly either from the outer diameter of the disc to the inner side in a radial direction or at a tangent to the disc. The fibre always extends along a curve from the center to the circumference or vice versa.

WO 98/49382 (B. F. Goodrich) describes a method wherein a mass of loose fibre is accreted into a thick fibrous structure by repeatedly driving a multitude of felting needles into the loose fibre, the felting needles penetrating all the way through the fibrous material at the beginning of the process, and penetrating only part way through the fibrous material at the end of the process. The orientation of the loose fibre in the finished preform is, therefore, random.

EP 0 232 059 (P. G. Lawton Limited) describes a method of manufacturing a carbon fibre disc wherein the disc is built by adding segments, one by one, in a spiral, layer upon layer. Some segments have continuous filaments extending chordally and others radially. The layers of segments are connected by needling. Hence, the resulting preform has filaments that extend chordally, radially and transversely, the last being produced by the needling head.

GB 2 428 253 (P. G. Lawton (Industrial Services) Limited) describes a method of manufacturing a stack of fibrous material that is built up in the direction of the longitudinal axis of the stack by causing relative movement of a support for the stack and at least one feed of fibrous material adding fibrous material to build the stack. The stack is therefore built up in overlying layers which are connected by needling.

The last two disclosures describe the manufacture of discs and cylindrical stacks based on an 'xyz' principle wherein the fibres extend chordally (x direction), radially (y direction) and longitudinally (z direction) with respect to one another. Such a three dimensional configuration of fibres increases the strength of the finished product. However, it will be appreciated that in these inventions there are disrupted fibres at the inner and outer circumferences of the disc or stack which must be machined away after carbonization. Also, as the fibres in the longitudinal direction are those which are needle punched, they do not necessarily extend through the whole of the stack or disc, which is basically built up in a series of layers that are needle punched together. This can result in a stack or disc that has a propensity to fail owing to delamination.

In addition to the foregoing, none of the inventions is suited to the manufacture of hollow structures. The only way these could be manufactured would be to machine the stack of material after carbonization to reduce the cylindrical stack to the shape of the hollow structure required. This is not economically viable in most cases as most of the stack would be machined away and, therefore, wasted.

BRIEF SUMMARY OF THE INVENTION

The object of the present invention is to provide a method of manufacturing a fibrous structure which is less wasteful of material and which produces a superior fibre distribution in the axial direction to overcome or substantially mitigate the aforementioned problems. A further object is to provide a economically viable method of manufacturing a hollow preform structure.

According to a first aspect of the present invention there is provided a method of manufacturing a fibrous structure comprising the steps of: fixedly mounting a former on a shaft; rotating the shaft about its longitudinal axis; providing a plurality of first feeds of fibrous material spaced along the length of the shaft; providing a second feed of fibrous material; applying the first feeds of fibrous material to the former in a direction tangential to the shaft as the shaft is rotated; applying the second feed of fibrous material to the former in a direction substantially parallel to the longitudinal axis of the shaft, the fibrous materials in the first feed and the second feed overlying one another as the shaft rotates and the thickness of the fibrous material applied to the former increases to form the fibrous structure; and causing selected lengths of the first and/or second feeds to be inserted into the body of the fibrous structure in a radial direction with respect to the shaft as the shaft is rotated to interconnect the overlying layers formed by the first and second feeds and thereby hold the fibrous structure together.

It will be appreciated that in the present invention, unlike the prior art described above, the fibrous structure is built up radially and not in the axial direction. Hence, the fibres that extend in the 'x' direction are applied at a tangent to the shaft and are wound around the support rather than extending chordally as in the prior art. Also, there is continuous fibre distribution is the 'z' direction long the length of the shaft unlike the prior art wherein only short needle-punched fibres lie in this direction. This significantly increases the strength of the structure and much reduces the risk of delamination of the structure after carbonization.

Preferably, the first feeds of fibrous material are continuously applied to the former. In contrast, the second feed of fibrous material is preferably applied in discrete lengths along a predetermined length of the former. The predetermined length may comprise the whole length of the former.

Preferably also, the speed of rotation of the shaft is varied as the thickness of the fibrous material applied to the former increases to ensure an even pattern of insertion of the selected lengths of the first and/or second feeds.

Preferably also, the first feeds of fibrous material are pulled on to the former in the direction tangential to the shaft as the shaft rotates.

Preferably also, the shaft is moved linearly away from the point of insertion of the selected lengths of the first and/or second feeds as the thickness of the fibrous material applied to the former increases to ensure a constant insertion depth.

Preferably also, the shaft is orientated in a substantially horizontal direction and is vertically movable in a frame.

Preferably also, the selected lengths of the first and/or second feeds are inserted into the body of the fibrous structure in a radial direction by needle-punching.

Preferably also, the first and/or second feeds are entangled within the body of the fibrous structure in a radial direction by high pressure gas jets.

Preferably also, the former is located on the shaft between containment shields which hold the fibrous material in place on the former as the fibrous structure is being formed.

Preferably also, the former comprises a resilient support. Advantageously, the former is made from foam.

According to a second aspect of the present invention there is provided an apparatus for manufacturing a fibrous structure comprising: a former fixedly mounted on a shaft adapted to be rotatably driven about its longitudinal axis; a plurality of first feeds of fibrous material spaced along the length of the shaft to apply fibrous material to the former in a direction tangential to the shaft as the shaft is rotated; a second feed of fibrous material adapted to apply fibrous material to the former in a direction substantially parallel to the longitudinal axis of the shaft, whereby the fibrous materials in the first feed and the second feed overlying one another as the shaft rotates and the thickness of the fibrous material applied to the former increases to form the fibrous structure; and insertion means for causing selected lengths of the first and/or second feeds to be inserted into the body of the fibrous structure in a radial direction with respect to the shaft as the shaft is rotated to interconnect the overlying layers formed by the first and second feeds and thereby hold the fibrous structure together.

According to a third aspect of the present invention there is provided a fibrous structure manufactured in accordance with the method of the first aspect of the present invention.

Other preferred but non-essential features of the various aspects of the present invention are described in the dependent claims appended hereto.

BRIEF DESCRIPTION OF THE SEVERAL VIEWS OF THE DRAWINGS

The various aspects of the present invention will now be described by way of example with reference to the accompanying drawings, in which.

DETAILED DESCRIPTION OF THE INVENTION

Figure 1:
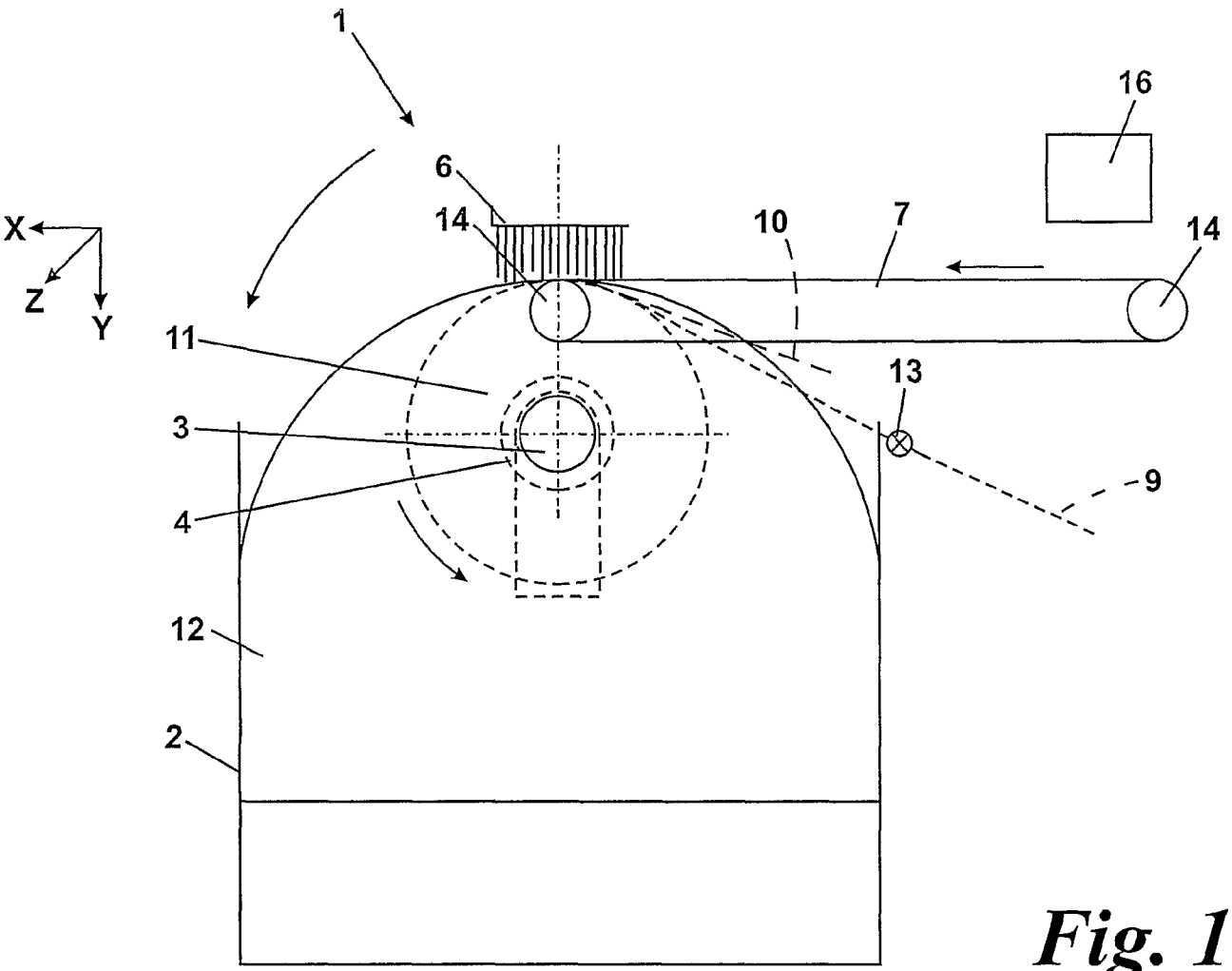
FIG. 1 is schematic end view of a first embodiment of apparatus for manufacturing a fibrous structure.

In both embodiments, the apparatus 1 comprises a frame 2 in which a shaft is rotatably mounted in a substantially horizontal orientation. A former 4 is fixedly mounted on the shaft 3 and a preform is built up over the former 4 during operation of the machine. The former 4 therefore has an exterior profile which mirrors that of the preform structure to be constructed around it and rotates with the shaft 3. In the present example, the former 4 comprises a cylindrical sleeve that is mounted on the shaft 3. The shaft 3 and therefore the former 4 are rotated by an infinitely variable drive means 5 (see FIG. 5) as it is necessary to vary the speed of rotation of the shaft 3 during operation to achieve a even fibre insertion pattern, as is described in more detail below.

Figure 2:
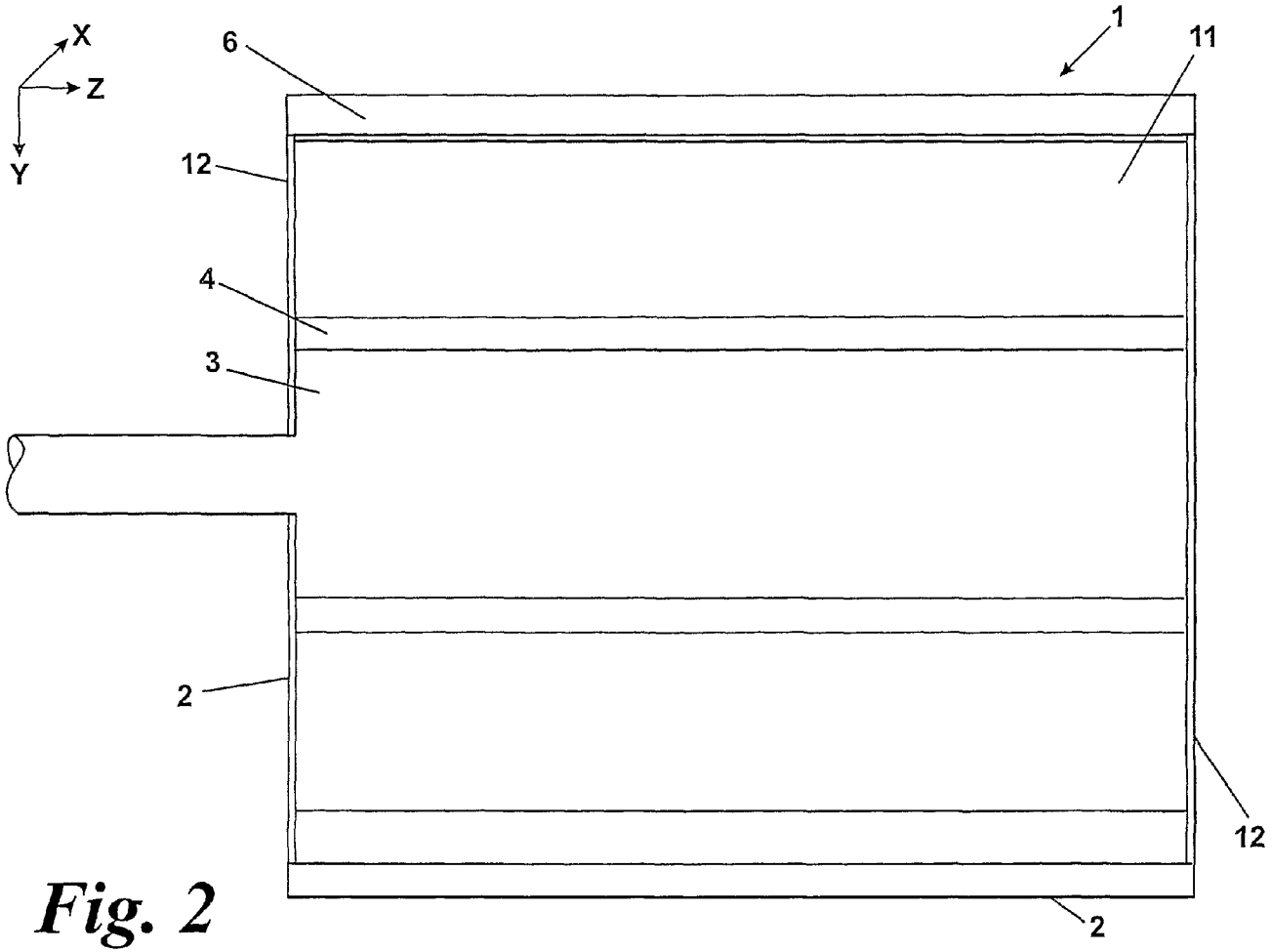
FIG. 2 is a schematic side view of the apparatus of FIG. 1 shown holding a fibrous structure which has been formed thereon.
Figure 3:
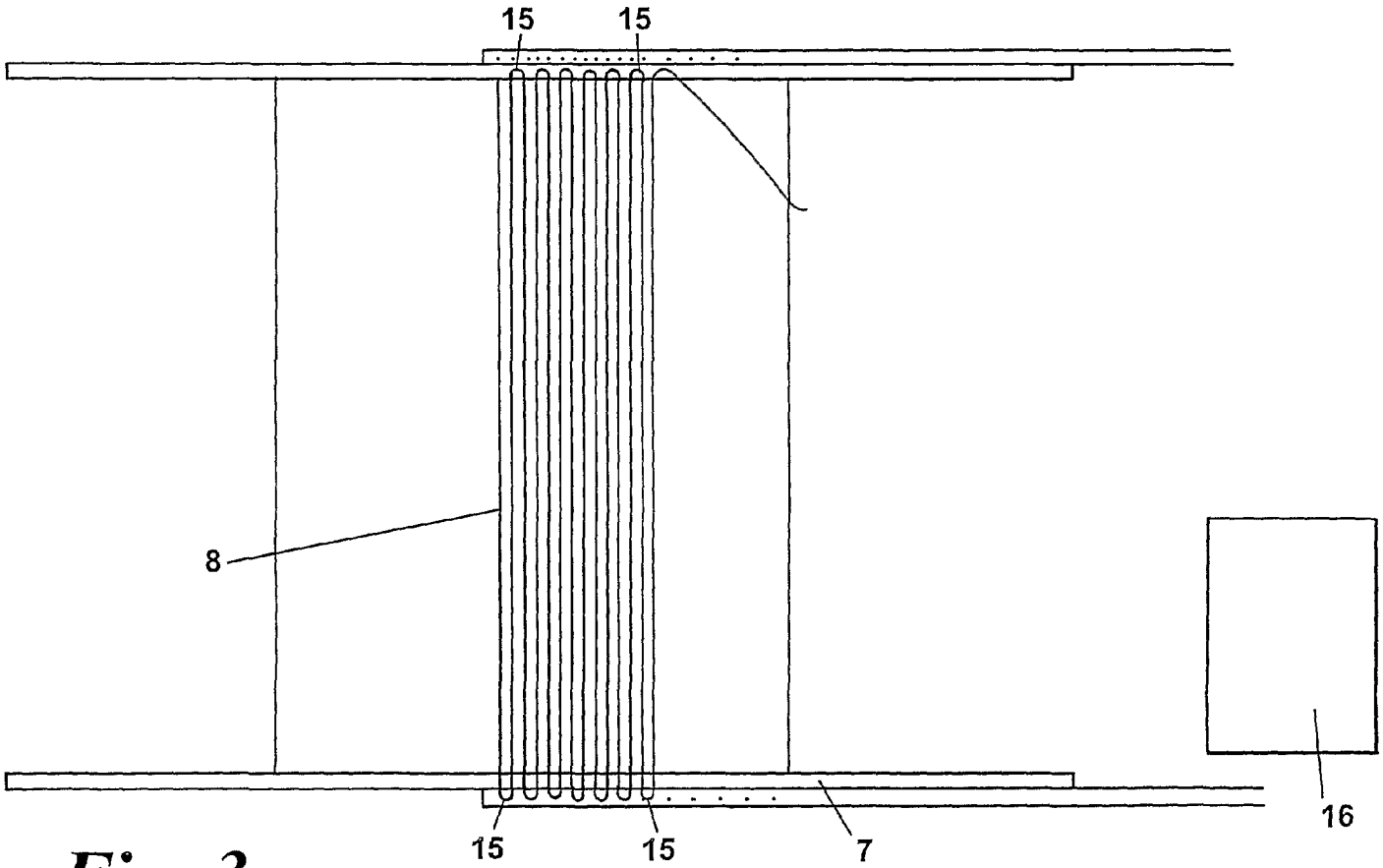
FIG. 3 is a schematic plan view of a pair of hook carriers forming part of the apparatus shown in FIG. 1.

In the first embodiment shown in FIGS. 1 to 3, a needling head 6 is located vertically above the shaft 3 and at each end it is one of a pair of mechanically linked hook carriers 7 that convey a feed 8 of fibrous material that is to be applied to the former 4 in a direction substantially parallel to the longitudinal axis of the shaft 3. Beneath the carriers 7 is located a plurality of feeds 9 of fibrous material for application to the former 4 in a direction tangential to the shaft 3 as it is rotated. In some applications, if it is desired to increase the fibre density of the preform, additional fibres or a web 10 of fibrous material can also be applied to the former 4 in a direction tangential to the shaft 3 as it is rotated in addition to the fibre feeds 9. Typically, the applied web 10 will comprise a non-woven web and it will be appreciated that its length can be commensurate with the length of the former 4. However, for some applications, webs 10 could be applied at strategic positions along the length of the former 4.

The construction and operation of the needling head 6, the hook carriers 7 and the feeds 9 is described in more detail below but it will be appreciated that the fibrous materials applied to the former 4 from the hook carriers and the feeds 9 overlie one another in layers on the former 4 as the shaft 3 and the thickness of the fibrous material applied to the former 4 increases to form a fibrous preform structure 11. Once the structure 11 has been completely formed to the size shown in dashed lines, the fibrous material comprising the feeds 8 and 9 and the web 10 can be cut and the former 4 removed from the shaft 3 along with the structure 11. To facilitate this, the shaft 3 may comprise an air shaft. After doffing, the former 4 can be removed from the structure 11, which can then be further treated, for example by being carbonized, for produce a preform suitable for brake discs or the like.

In addition to its rotational movement, the shaft 3 is also movable vertically up and down relative to the frame 2 between roll containment shields 12 that are located at the ends of the shaft 3. The purpose of the shields 12 is to hold the fibrous material in place on the former 4 as the fibrous structure 11 is being formed. As the thickness of the structure 11 increases during operation of the apparatus 1, the shaft 3 is moved vertically downwards relative to the frame 2 and away from the needling head 6 in order to keep a constant needling depth throughout the production cycle. The rate of descent is controlled and can be calculated directly from the rate at which the thickness of the structure 11 increases, for example by monitoring the thickness using a physical means such as a transducer, a laser or any other means of feedback.

The structure 11 is built up on the former 4 by means of the hook carriers 7 and the feeds 9. These will now be described in more detail.

First, the feeds 9 of fibrous material are supplied from a creel (not shown) and are pulled into the structure 11 as the former 4 rotates on the shaft 3. The number of feeds 9 required is related to the length of the structure 11 and its cross-sectional profile and the desired fibre ratio/mix/weight of the structure 11 along its length. The feeds 9 are applied to the former 4 in a direction tangential to the shaft 3 as the shaft 3 is rotated. These feeds 9 therefore supply the fibres that extend in the 'x' direction of the structure and are wound around the former 4. One or more eyes 13 are provided through which the fibrous material passes to ensure smoothing running and feeding of the fibrous material. As the feeds 9 are pulled into the structure by rotation of the former 4, the rate of delivery of the feeds 9 to the former 4 is always at a constant rate in the direction tangential to the shaft 3.

If a web 10 of material is also supplied, this is also pulled onto the former 4 as the shaft 3 rotates. However, in some embodiments, it may be appropriate for the web 10 to be supplied by one or more pairs of feed rollers (not shown) which would be driven by an infinitely variable drive means so that the rate of delivery of the web 10 can be varied as the thickness of the structure 11 increases. It will be appreciated, that as the thickness increases, so the rate of delivery of the web 10 must be increased assuming that the rate of rotation of the shaft 3 remains the same. Control of the drive means for the feed rollers can be linked mechanically to the drive means 3*a* or controlled by an encoder (not shown) which is also used to control the drive means 3*a*.

The hook carriers 7 convey the feed 8 of fibrous material which is to be applied to the former 4 in a direction substantially parallel to the longitudinal axis of the shaft 3 in the 'z' direction of the structure 11. Each hook carrier 7 comprises an endless chain or belt that is driven around a pair of pulleys or sprockets 14 located at each end of the shaft 3 with their axes of rotation parallel to the longitudinal axis of the shaft 3. Spaced along the chain or belt of each hook carrier 7 is a series of hooks 15 around which the fibrous material is wound cross-wise between the chains or belts by a traversing carriage 16. The carriage 16 is driven by a linear rack and pinion actuator or any other suitable drive means. The hook carriers 7 feed the fibrous material under the needling head 6 where the end loops of fibrous material are pulled off their carrying hooks 15 by the shields 12 as the hooks 15 pass below the upper rims of the shields 12. This deposits the loops of fibrous material longitudinally along the length of the structure 11. The looped ends of the fibrous material will fall outside the length of the former 4 and will be evident as disrupted fibres at both ends of the finished preform. These can be removed during the machining operation that will take place after carbonizing.

In order to achieve a three dimensional matrix of fibres within the structures, it is necessary to introduce a fibres in the 'y' direction that extend at perpendicular to those being fed circumferentially and longitudinally on the structure. This is accomplished by inserting selected lengths of the circumferential and longitudinal fibres into the structure 11 in a radial direction, the 'y' direction, with respect to the shaft 3 as the shaft 3 is rotated. These inserted fibres interconnect the overlying layers formed by the feeds 8 and 9 and thereby hold the fibrous structure 11 together. In the embodiments illustrated herein, these radially extended fibres are produced by needle punching the circumferential and longitudinal fibres from the feeds 8 and 9 but it is also possible for to use high pressure gas jets, typically air jets, to entangle these fibres into the body of the structure 11 primarily in a radial direction. Typically, this entanglement would be in addition to needle punching but there may be circumstances where gas jet insertion may be sufficient without needle punching being necessary.

Figure 7:
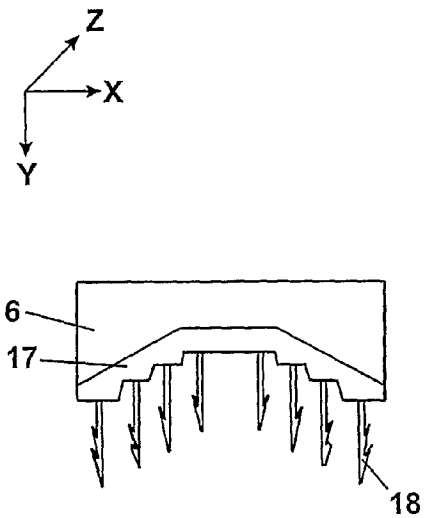
FIG. 7 is a diagram showing the cross-sectional profile of a needle holder for a needling head forming part of both the first and the second embodiments.

In both the first and second embodiments, the needling head 6 extends along the full length of the former 4. As shown in FIG. 7, the head 6 comprises a needle holder 17 that has a graduated depth along its transverse profile so that needles 18 along each of these profiles are arranged so to be substantially the same distance from the former 4. Each transverse bank of needles 18 is therefore stepped along an arc which is equidistant from the longitudinal axis of the shaft 3 along its length. It will be appreciated, however, that a compromise must be reached between the inside and outside diameter of the structure 11 but the arrangement of the needles 18 in this way means that the depth of needling into the structure 11 is substantially constant. The fibrous material wound onto the structure 11 from the feeds 9 and the longitudinally aligned fibrous material applied to the structure 11 from the hook carriers 7 passes beneath the needling head 6 so that fibres therefrom are inserted into the structure 11 radially. During needling at the beginning of the production of the structure 11, the needles 18 may penetrate the former 4. Advantageously, therefore, the former 4 is made of a resilient material such as foam to allow the needles 18 to penetrate and be retracted easily without the former 4 loosing its shape. As the structure 11 increases in thickness, however, the needles 18 may no longer penetrate the former 4.

Figure 4:
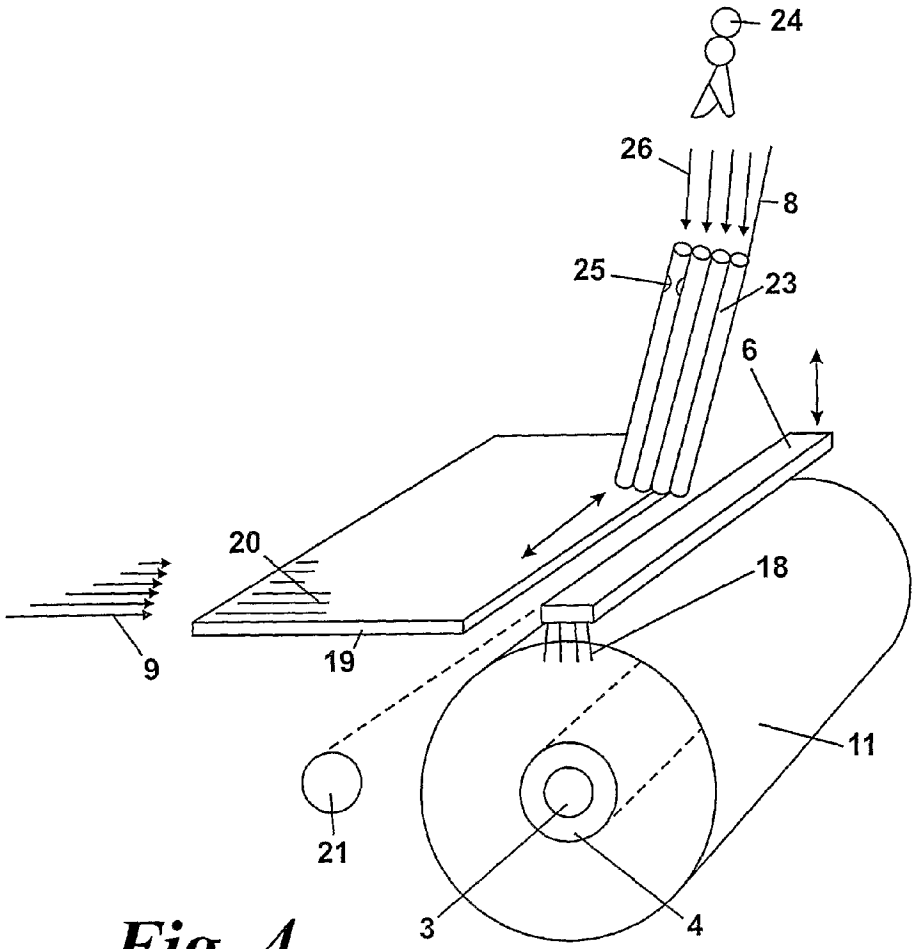
FIG. 4 is a schematic perspective view of a second embodiment of apparatus for manufacturing a fibrous structure.
Figure 5:
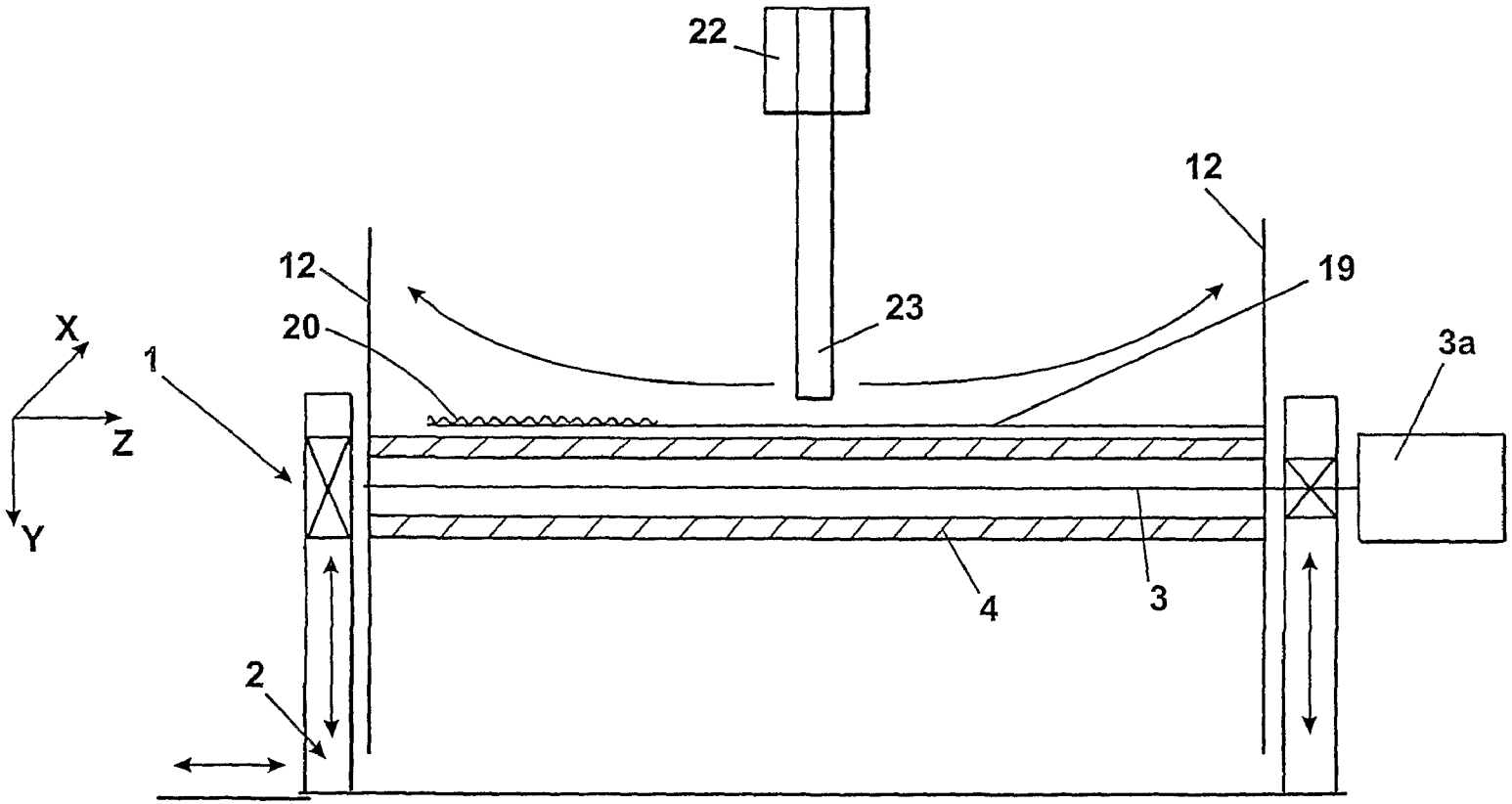
FIG. 5 is a side view of the apparatus shown in FIG. 4.
Figure 6:
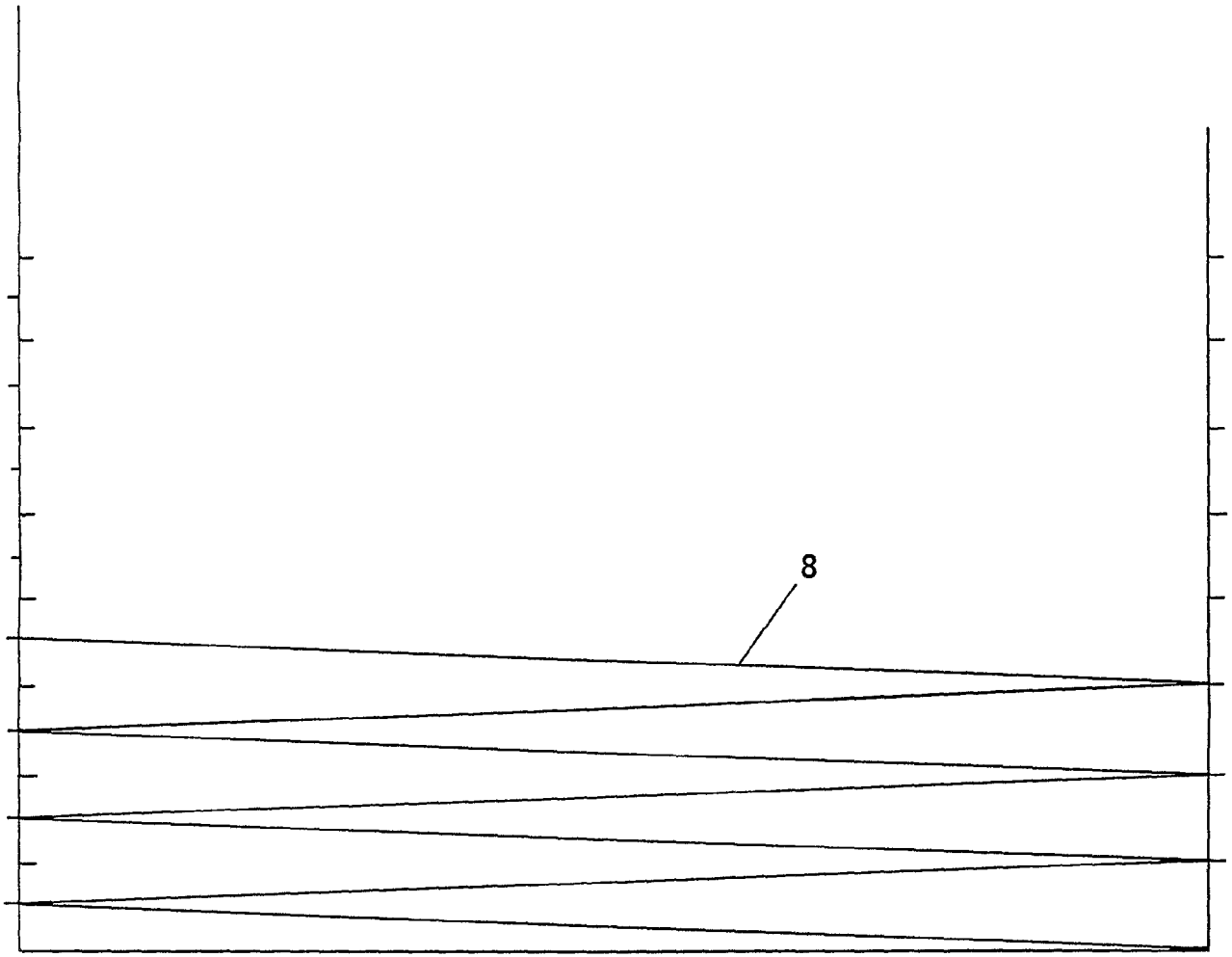
FIG. 6 is a diagram showing the lay pattern of fibres in a longitudinal direction along the length of the apparatus shown in FIGS. 4 and 5.

In the second embodiment, the feeds 8 and 9 are produced differently although the end result is the same. Referring now to FIGS. 4 to 6, the feeds 9 in the 'x' direction are still supplied from a creel but in this case via a substantially horizontal grooved platen 19. The number of grooves 20 in use in the platen 19 is determined according to the number of feeds 9 of fibrous material required to achieve the correct fibre ratio/mix/weight for the structure 11 to be produced. The grooves 20 are approximately 200 mm long and are polished to prevent snagging of the fibrous material, which is pulled onto the former 4 at it is rotated on the shaft 3. The platen 19 holds the feeds 9 at the correct spacing prior to needling and prevents tangling. As in the first embodiment, provision is also made for the supply of additional fibres or webs into the structure 11. These can be pulled directly into the structure or be supplied via one or more pairs of feed rollers 21.

The feed 8 in the 'z' direction that is applied to the former 4 in a direction substantially parallel to the longitudinal axis of the shaft 3 in this embodiment is carried in a swinging carriage 22. The carriage 22 carries at least one but preferably a plurality of feed tubes 23 through which fibrous material is fed by infinitely variable feed rollers 24. The tubes 23 have a venturi 25 at their upper ends where the feed 8 enters the tubes 23 and an air flow 26 down each tube 23 is provided from a blower (not shown) via the venturi 25 which accelerates the flow to assist passage of the feed through the tube 23. A consequence of the air flow is that spreading of the fibres of the feed can occur on its exit from the tube 23 so control of the rate of the air flow is important to minimize this effect while still providing sufficient air flow to carry the feed through the tube 23. As the carriage 22 swings over the former 4 in a direction at 90° to the direction of the feed 9, the fibres in the feed 8 can be laid in various patterns on the former 4 by varying the period of oscillation of the carriage 22 and by swinging the tubes 23 in a controlled manner relative thereto, as indicated in FIG. 5. The length of the tubes 23 can also be varied to alter the lay pattern. Patterns of a zigzag form, such as shown in FIG. 6 or annular, oval patterns can be achieved as can variations thereof. The lay pattern in FIG. 6 shows a zigzag lay wherein the ratio of width, along the length of the former 4, to length, i.e. around the circumference of the former, is 14:1.

One advantage of using a swinging carriage 22 to apply the feed 8 in the 'z' direction to the former 4 is that the movement of the carriage 22 can be controlled to lay down more fibre over selected parts of the former 4 so that structures with relatively complex shapes can be produced. It is also possible to increase the feed 8 in selected parts of the structure to reinforce these areas.

In both the first and the second embodiments described above, it will be appreciated that the method of laying the feed 8 in the 'z' direction will result in disrupted fibres at the ends of the former 4. In both cases, however, this can be readily machined away after carbonization of the structure 11. Generally, however, the present invention enables hollow structures to be produced with considerably less wastage of material and without significant machining being necessary after carbonization has taken place.

In the embodiments described above, the former 4 is shown in the drawings as a cylindrical sleeve in order that the carbonized structure 11 comprises a cylindrical tube. Discs suitable for the production of composite aircraft, automobile or railway brakes can then be produced by slicing the tube into discs of appropriate thickness. However, the former 4 could comprise any hollow shape capable of mounting on the shaft 3. Elliptical, orthogonal or square tube formers could all be used for the production of many different types of structures. In addition, the cross-sectional area of the former 4 can vary. In these cases the angle of the shaft 3 to the vertical can be varied appropriately during production of the preform structure 11 in order that a substantially flat surface is always presented beneath the needling head 6 and/or the gas jet area. Alternatively or in addition, the shape of the needling head 6 and/or the gas jet apparatus can be varied so that it follows the underlying contour of the former 4. Such an arrangement enables a cone-shaped former 4 to be used which can be used to produce a one-piece hollow nozzle or nose cone for a projectile.

The present invention has several advantages, as follows, over the prior art. It produces little or no waste in the production of a preform as very little, if any, material has to be machined away from the preform structure. It is simple to operate and provides for quick set up as differently sized tubes/discs can be accommodated without requiring different sizes of shafts. When producing a preform for a disc brake, several discs can be produced in the time cycle it takes to produce one. Quantities of 20/30 discs per cycle are possible. The continuous fibre distribution achieved in the axial direction is superior to the prior art which in turn reduces any tendency of the preform structure to delaminate. The fibres in the 'x' direction, tangential to the former, are continuously wound around the structure, which is thereby significantly stronger than those produced using prior art methods.

We claim:

1. A method of manufacturing a fibrous structure, the method comprising:

fixedly mounting a former onto a shaft, said shaft having a longitudinal axis;

rotating said shaft about said longitudinal axis;

providing a plurality of first feeds of fibrous material, each of said plurality of first feed having the fibrous material in a continuous form, said plurality of first feeds being spaced from each other along a length of said shaft;

providing a second feed of fibrous material;

continuously applying said plurality of first feeds of fibrous material to said former in a direction tangential to said shaft as said shaft is rotated;

applying said second feed of fibrous material to said former in a direction substantially parallel to said longitudinal axis of said shaft, the fibrous material in the first feed and the second feed overlying one another as said shaft rotates and a thickness of the fibrous material applied to the former increases to form the fibrous structure; and causing selected lengths of the first or second feeds to be inserted into the fibrous structure in a radial direction with respect to said shaft as said shaft rotates to interconnect overlying layers formed by the first and second feeds so as to hold the fibrous structure together.

2. The method of claim 1, wherein the second feed of fibrous material is applied in discrete lengths along a predetermined length of said former, said predetermined length being inclusive of an entire length of the former.

3. The method of claim 2, wherein the predetermined length is the entire length of said former.

4. The method of claims 1, wherein a speed of rotation of the shaft is varied as the thickness of the fibrous material applied to said former increases and wherein the first feeds of fibrous material are pulled onto said former in the direction tangential to said shaft as said shaft rotates.

5. The method of claim 1, wherein said shaft is moved linearly away from a point of insertion of the selected lengths of the first or second feeds as the thickness of the fibrous material applied to said former increases to ensure a constant insertion depth.

6. The method of claim 1, wherein said shaft is vertically movable in a frame.

7. The method of claim 1, wherein the selected lengths of the first or second feeds are inserted into the fibrous structure in a radial direction by one of a needle-punching head and a high pressure gas jet, said needle-punching head having a shape which follows an underlying contour of said former.

8. The method of claim 1, wherein an angle of said shaft to vertical is varied during production of the fibrous structure in order that a substantially flat surface is always presented.

9. The method of claim 1, wherein said former is located on said shaft between containment shields which hold the fibrous material in place on said former as the fibrous structure is being formed.

* * * * *